United States Patent [19]

Moser et al.

[11] 4,278,314

[45] Jul. 14, 1981

[54] CONNECTOR ASSEMBLY FOR FLAT CABLE CONDUCTORS IN MULTIPLE ROWS

[75] Inventors: Jesse L. Moser, Highpoint; John R. Shoemaker, Reidsville, both of N.C.

[73] Assignee: AMP Incorporated, Harrisburg, Pa.

[21] Appl. No.: 89,834

[22] Filed: Oct. 31, 1979

[51] Int. Cl.[3] ..... H01R 9/07

[52] U.S. Cl. ..... 339/99 R; 339/176 MF

[58] Field of Search ..... 339/17 F, 176 MF, 95, 339/98, 99

[56] References Cited

U.S. PATENT DOCUMENTS

| | | | |
|---|---|---|---|
| 3,691,509 | 9/1972 | Krol | 339/17 F |
| 3,848,946 | 11/1974 | Halley et al. | 339/17 F |
| 3,920,301 | 11/1975 | Roberts et al. | 339/99 R |
| 3,924,923 | 12/1975 | Shoemaker | 339/278 M |
| 3,959,868 | 6/1976 | Mathe | 339/97 P |
| 3,999,826 | 12/1976 | Yurtin | 339/17 F |
| 4,040,704 | 8/1977 | Huber | 339/99 R |
| 4,147,399 | 4/1979 | Moser et al. | 339/99 R |
| 4,160,573 | 7/1979 | Weisenburger | 339/99 R |

*Primary Examiner*—John McQuade

*Attorney, Agent, or Firm*—Gerald K. Kita

[57] ABSTRACT

An assembly is disclosed of an electrical connector and flat electrical cable having conductors disposed in two separate laminates. Each laminate, together with its conductors, is clamped between an inner connector body and an outer connector body, and then assembled onto an electrical plug or jack which contains electrical contacts which are joined electrically to the cable conductors upon assembly of the outer connector bodies over the electrical contacts.

6 Claims, 14 Drawing Figures

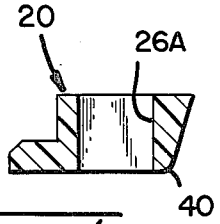
Fig. 4
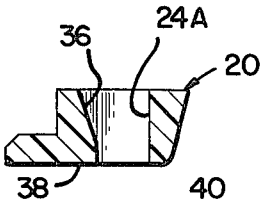
Fig. 5
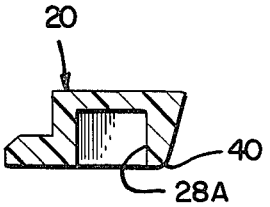
Fig. 6
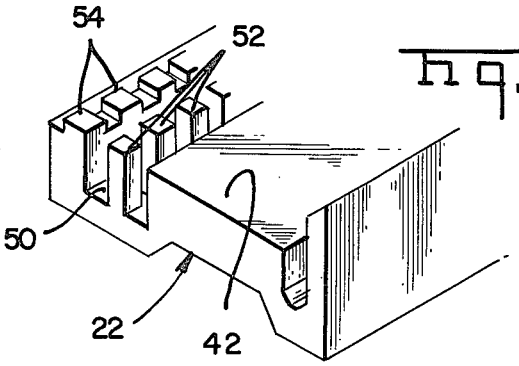
Fig. 3A
Fig. 7
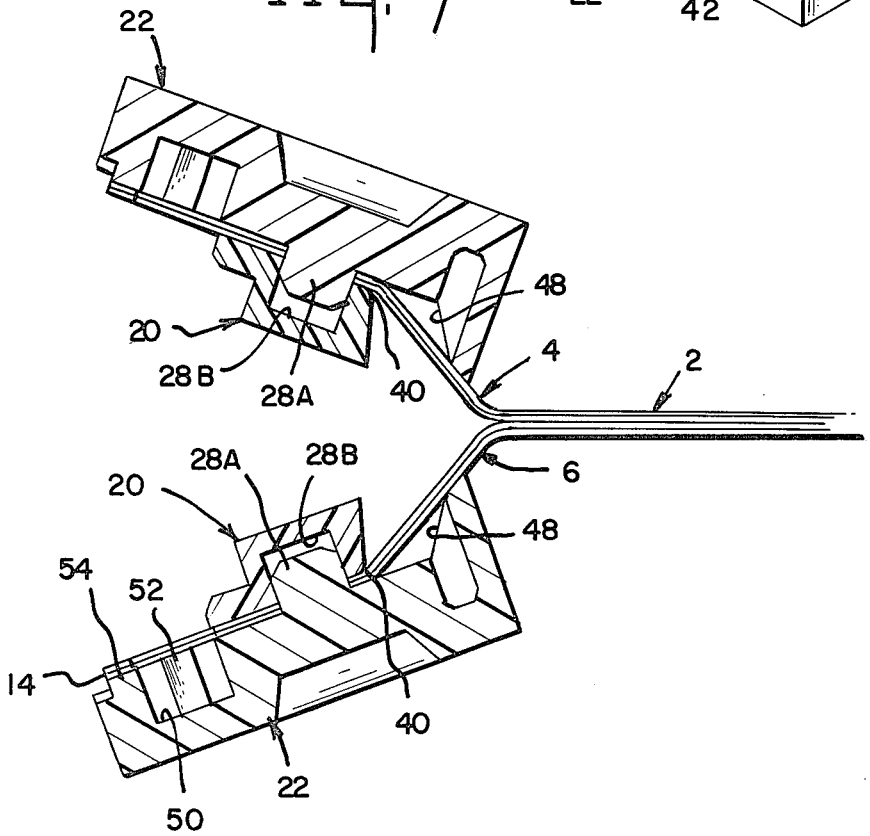

CONNECTOR ASSEMBLY FOR FLAT CABLE CONDUCTORS IN MULTIPLE ROWS

FIELD OF THE INVENTION

The present invention relates to an electrical connector for flat flexible cable expecially of the type wherein the multiple flat conductors are distributed in two parallel planes.

BACKGROUND OF THE PRIOR ART

Flat cable comprises multiple elongated conductors disposed parallel lengthwise and imbedded in a flat wide ribbon of flexible plastic insulation. The insulation is extruded over the conductors, or alternatively is built up from plastic sheet laminates covering the conductors and laminated together. The connector of the present invention is adapted for terminating the conductors of the cable type which is fabricated of laminates.

A particular cable is disclosed in U.S. Pat. No. 4,149,026, and comprises a first row of parallel flat conductors laminated between two sheets of plastic, together with a second row of parallel flat conductors laminated between two additional sheets of plastic. The inner laminates are bonded together to form a composite cable having two rows of conductors. At specific intervals along the length of the cable, the inner laminates are not bonded together for a few inches of length. Each row of conductors is thereby separate from the other and can be terminated with its own connector without disturbing the other row of conductors. If the cable terminus occurs at the separated rows of conductors, each row of conductors can be terminated into the same connector.

U.S. Pat. No. 3,760,335 discloses a electrical connector having two rows of contacts. The connector is in the form of a plug or a receptacle which can be pluggably connected together such that their contacts frictionally interconnect. The contacts in each type of connector include portions in the form of slotted terminals arranged in two rows. The two rows of conductors in the flat cable are forcibly inserted into the slotted terminals, establishing electrical connections therewith. The cable conductors thereby are provided with plug or receptacle type of connector as desired. One method for inserting a row of flat cable conductors is disclosed in U.S. Pat. No. 3,924,923.

SUMMARY OF THE INVENTION

The invention relates to an electrical connector assembly for electrically terminating two rows of flat conductors. Each row of conductors, together with the associated plastic covering is clamped between an assembled inner connector body and an outer connector body. The conductors thereby are supported and restrained from movement. The two rows of conductors, together with their outer connector bodies, are aligned with the rows of slotted terminals in either a plug or receptacle type connector as disclosed in U.S. Pat. No. 3,760,335. The outer connector bodies press the conductors into the slotted terminals, and assemble the inner and outer connector bodies, onto the cable and onto the plug or receptacle type connector. The outer connector bodies latch together. Each outer connector body is provided with latches which engage both inner connector bodies. The cable is provided with windows through which the latches project.

The inner and outer connector bodies are molded plastic, with integral projecting stuffer members which engage and press the row of cable conductors into the corresponding row of terminals. An all plastic connector assembly is achieved without a need for metal parts except for the contacts of the plug or receptacle.

The cable conductors of one row may be offset laterally of their lengths from the conductors of the other row. The separated sections of the cable row allows for lateral shifting of the cable rows to align with the corresponding rows of terminals in the plug or receptacle connector. Each row is separately provided with its own outer connector body which aligns the conductors with the terminals.

OBJECTS

An object of the invention is to provide inner and outer all plastic connector bodies for clamping a row of flat cable conductors and for pressing the conductors into a row of electrical terminals of a plug or receptacle connector.

Another object is to provide a connector assembly for terminating separate rows of conductors in a single flat cable by clamping each row between inner and outer plastic connector bodies and assembling the outer connector bodies over corresponding rows of electrical terminals of a plug or receptacle connector.

A further object is to provide a connector assembly in which connector bodies assembled onto each separate row of flat cable conductors, shift each row into alignment with rows of terminals in a plug or receptacle connector and terminate each row of conductors in each row of terminals upon assembly of the connector bodies to each other and to the connector.

Other objects and advantages of the invention will become apparent from the following detailed description and associated drawings.

DRAWINGS

FIGS. 3 and 3A are enlarged perspectives with parts in exploded configuration and illustrating the separated edge margins of a flat electrical cable and an inner connector body and an outer connector body for clamped cooperation on one of the edge margins.

Figure 5:
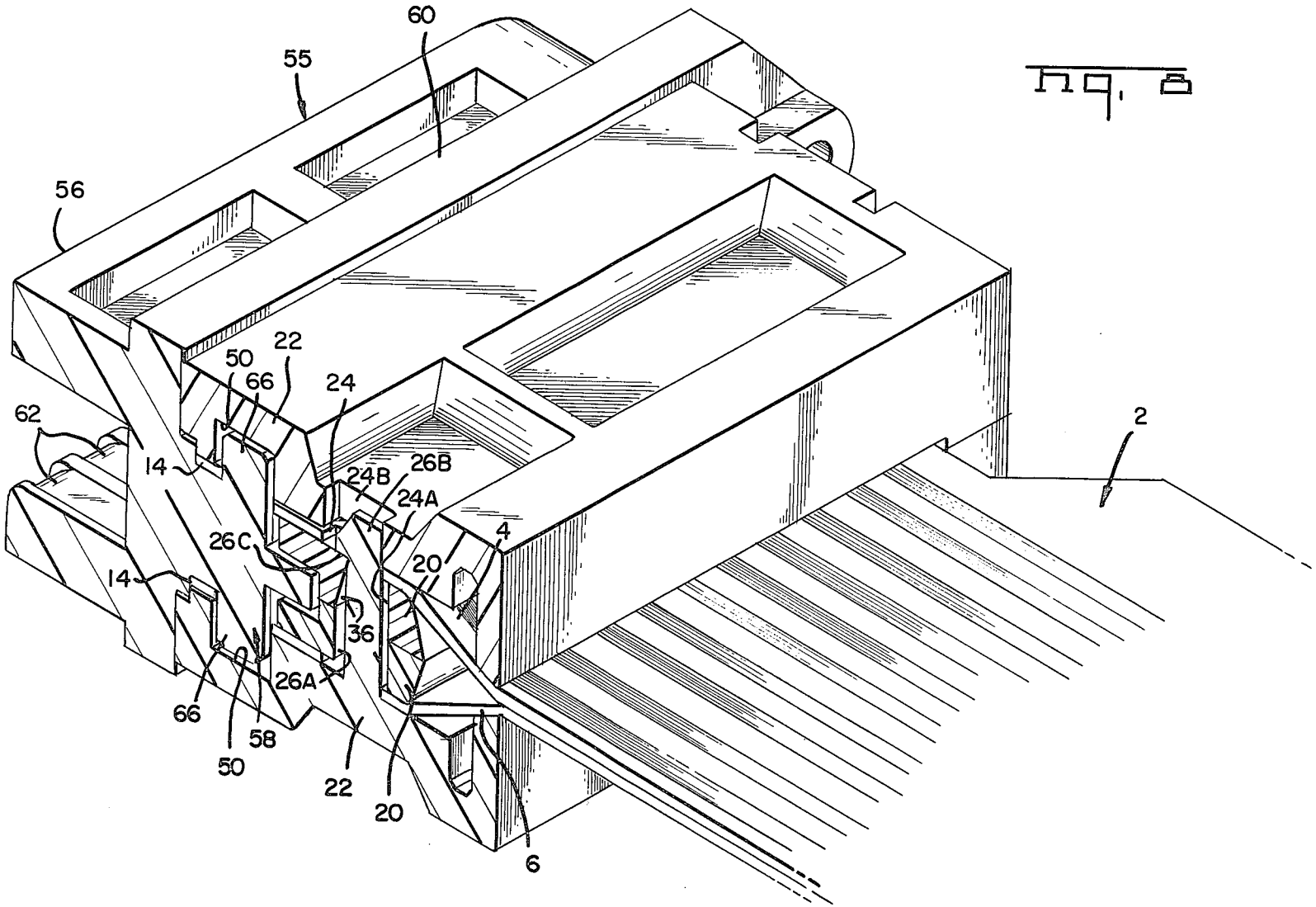
Figure 7:
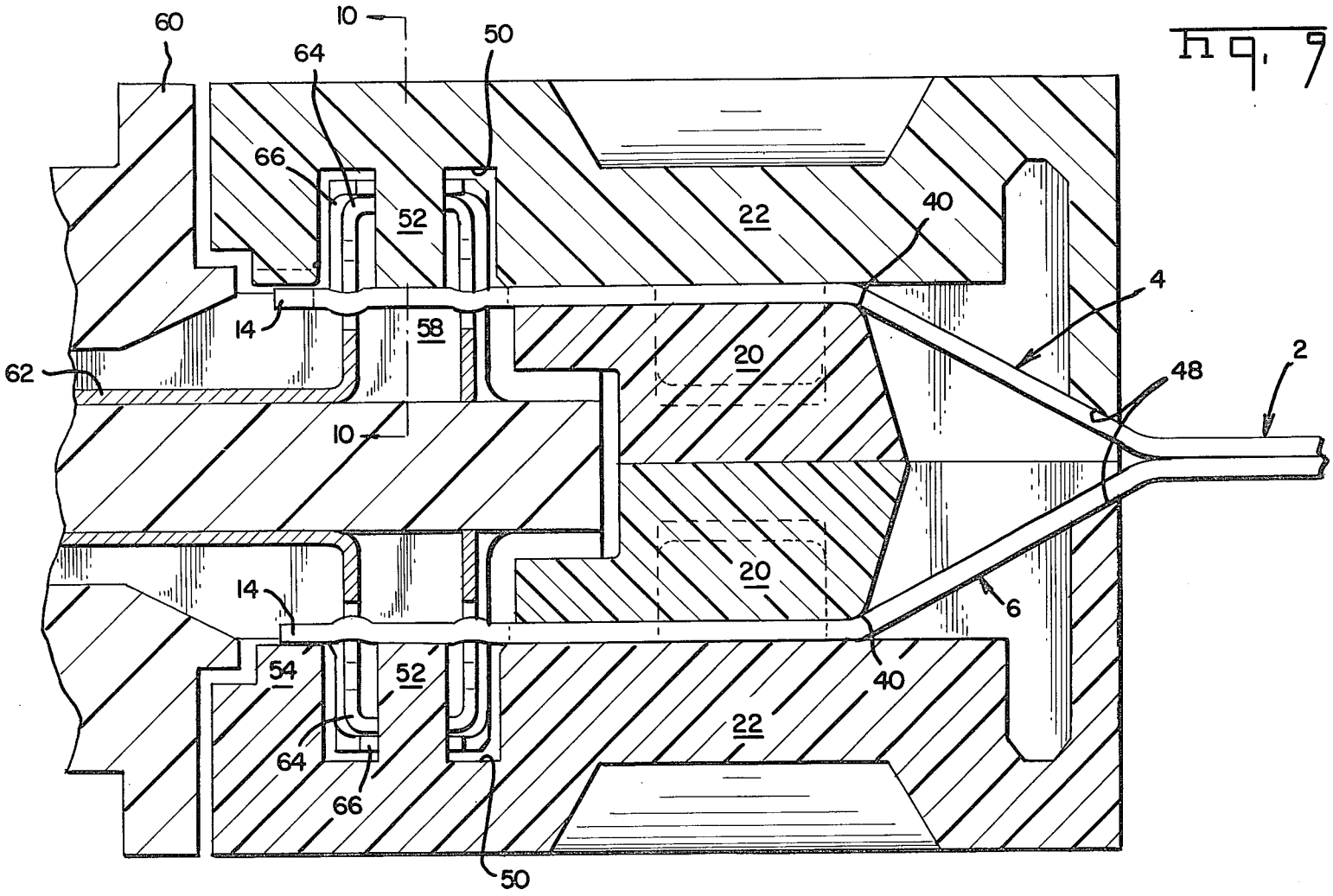

FIGS. 4, 5 and 6 are enlarged sections of the inner connector member taken along the lines 4—4, 5—5 and 6—6, respectively, of FIG. 3.

Figure 7:
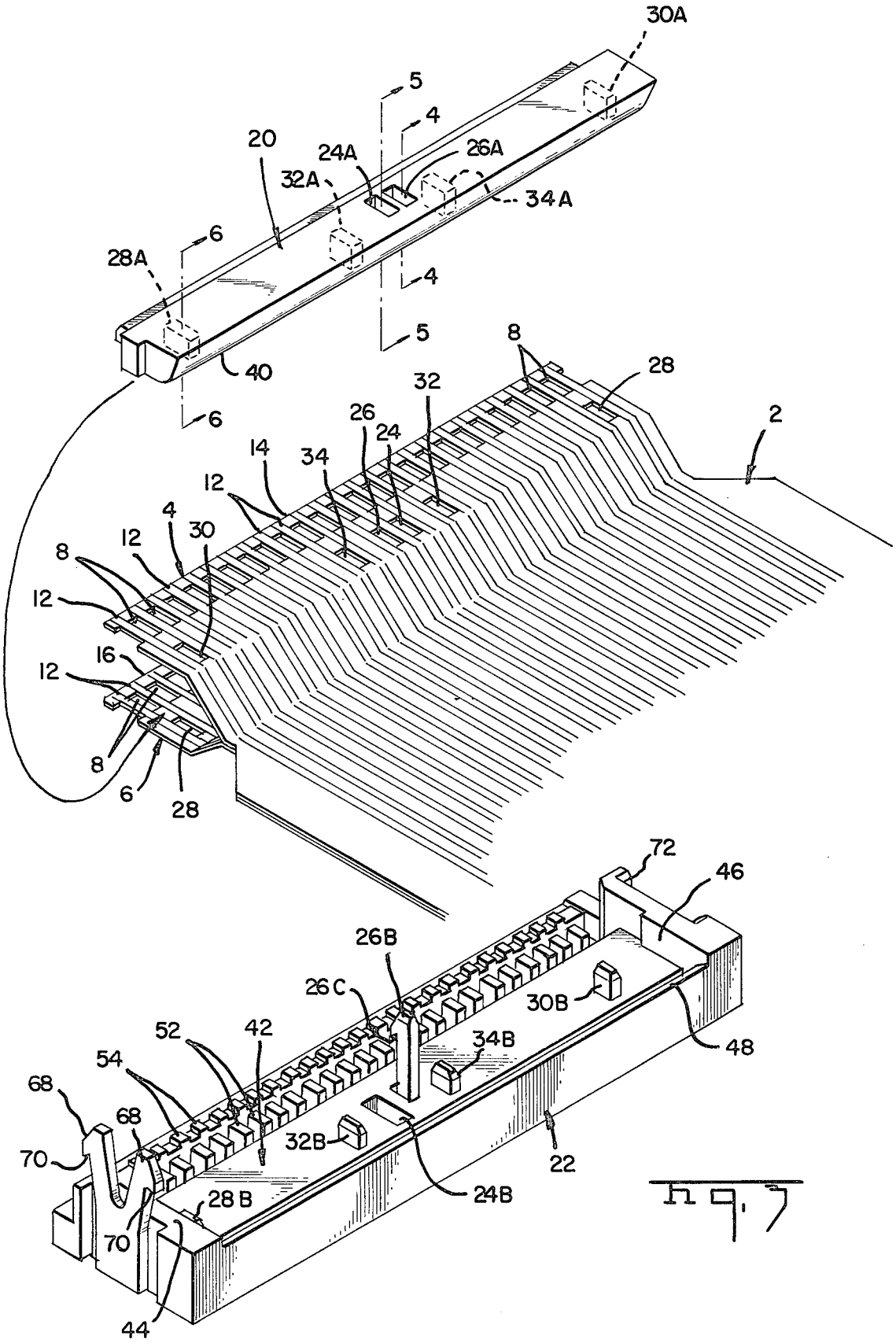

FIG. 7 is an enlarged side elevation of each edge margin clamped between a corresponding inner connector body and outer connector body.

Figure 2:
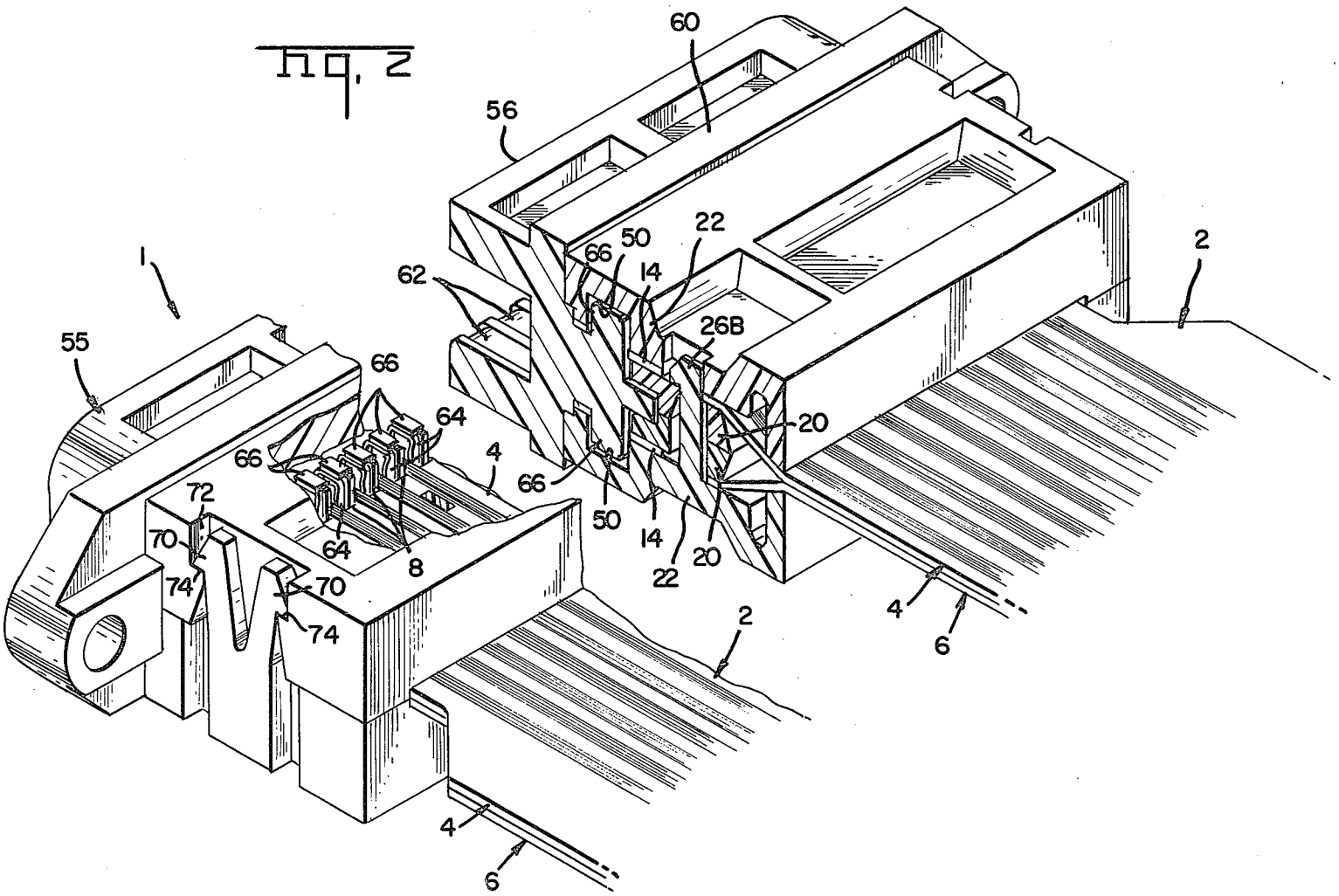
FIG. 2 is view similar to FIG. 1 with parts broken away and with parts in section.

FIG. 8 is an enlarged view similar to FIG. 2.

FIG. 9 is an enlarged side elevation in section of the electrical connector assembly.

Figure 10:
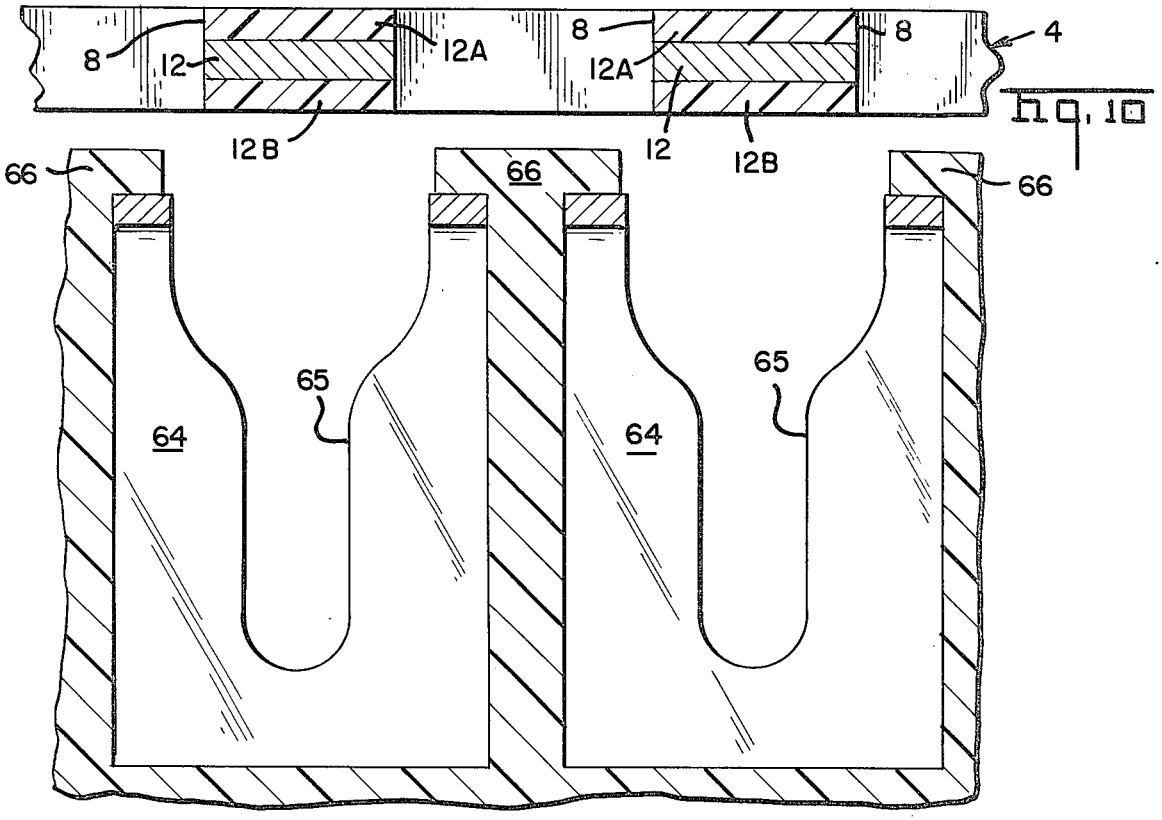
Figure 11:
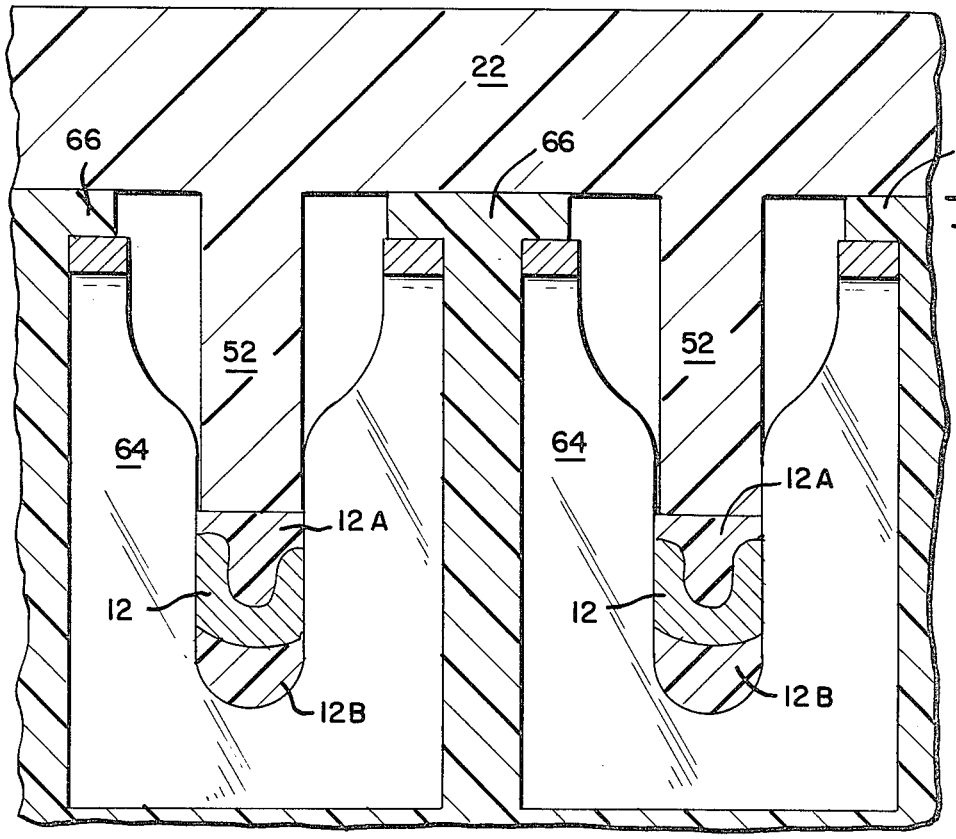

FIGS. 10 and 11 are fragmentary enlarged elevations in section illustrating the electrical connections of the cable conductors in electrical terminal portions of an electrical connector.

Figure 12:
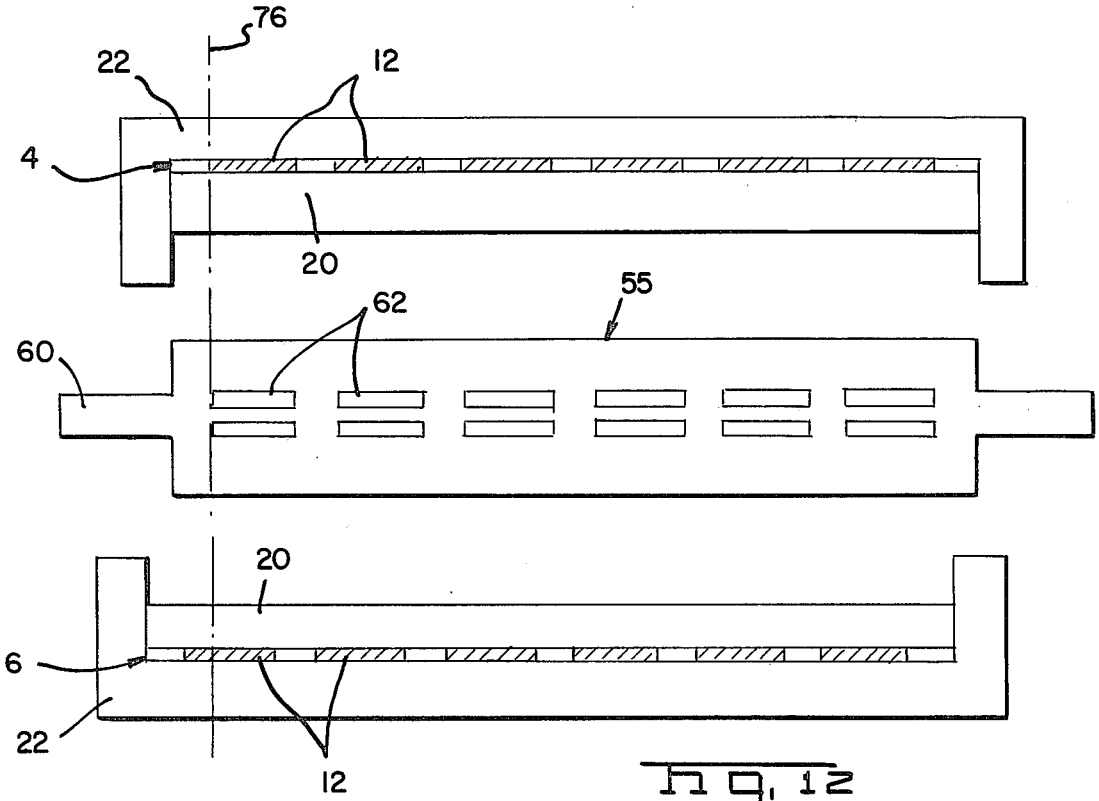
Figure 13:
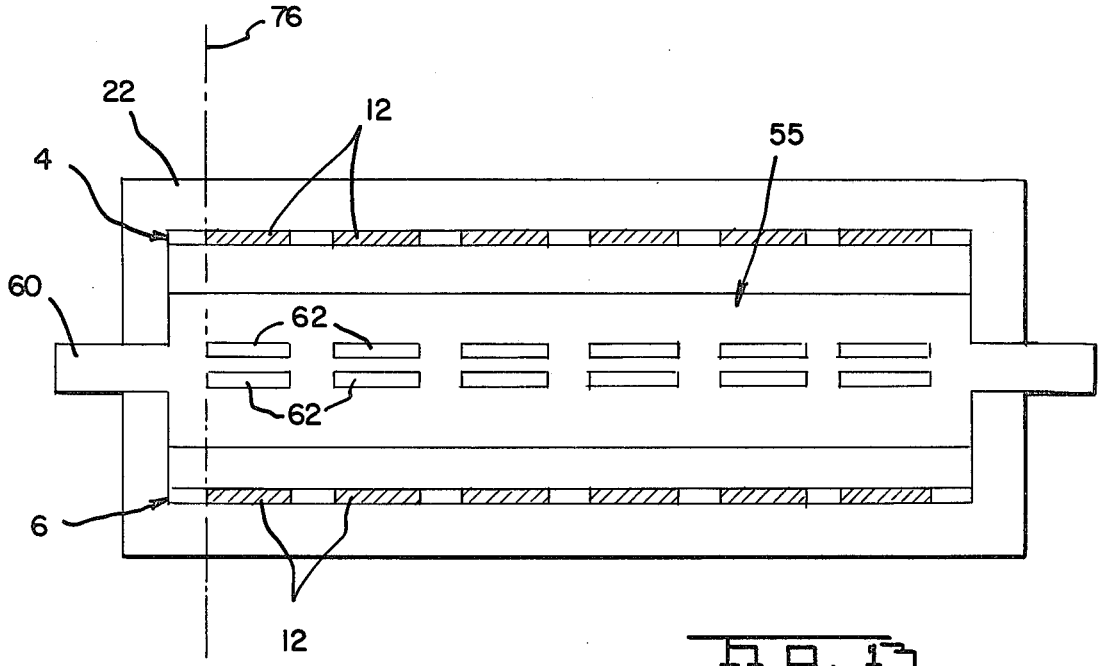

FIGS. 12 and 13 are diagrammatic views illustrating a shift laterally of one cable edge margin with respect to the other upon assembly of the outer connector bodies onto the electrical connector.

DETAILED DESCRIPTION

Figure 1:
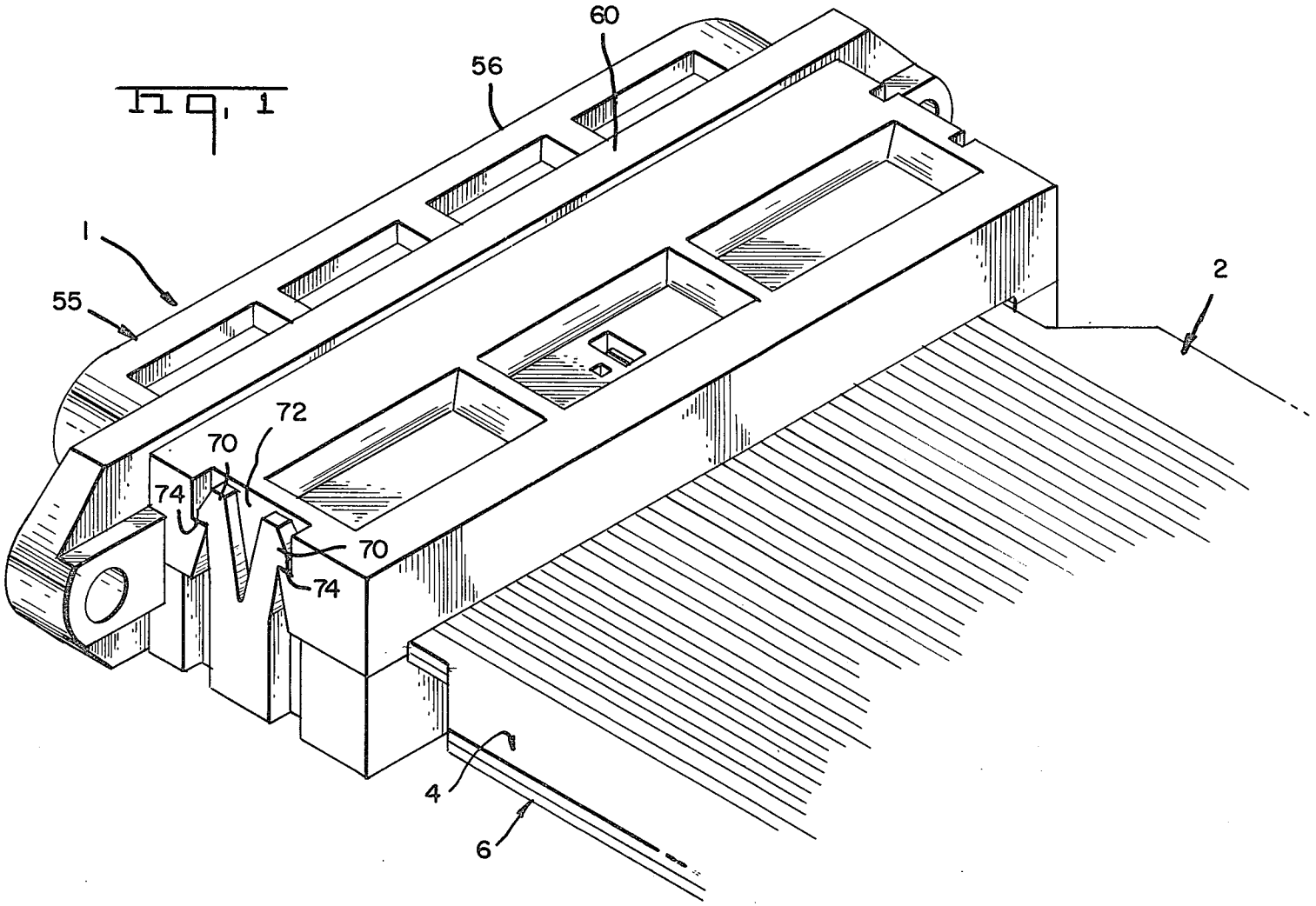
FIG. 1 is an enlarged perspective of an assembly of a flat cable, inner connector bodies and outer connector bodies, together with an electrical connector.

With more particular reference to FIGS. 1 and 2, an electrical connector assembly is shown generally at 1 assembled to a flat cable 2 having electrical conductors arranged in two rows 4 and 6. The rows 4 and 6 are laminated together as disclosed in U.S. Pat. No. 4,149,026, with the rows unlaminated at intervals along the cable length to allow separation of the rows and termination of each row to a multiple contact electrical connector. Although each row may be terminated to its own connector, for example, to provide a tap off, the present invention relates to termination of both rows in the same connector, and provides a connector assembly 1 for this purpose.

FIG. 3 illustrates the cable rows 4 and 6 ending with a separated section included in the cable length. Each row is punched or otherwise provided with a row of windows or apertures 8 alongside each conductor 12 of the row. The sides of the conductors are exposed by the windows 8 which allow the conductors to enter into electrical terminals, to be described. The end edge margins 16 of the rows 4 and 6, adjacent the windows, remain on the cable so that the row of conductors remain coplanar.

A second row of windows are provided on each cable row of conductors which provide for mechanical attachment of the cable row to its own inner connector body 20 which is disposed between rows 4 and 6 and outer connector body 22. Viewing the cable rows from opposite sides of the cable, each row has a pair of inner most windows 24, 26 on opposite lateral sides of the central axis of the cable row. Each cable row further has an outermost pair of windows 28, 30 adjacent outer side edge margins of the row. Each cable row further is provided with an intermediate pair of windows 32, 34.

The unitary inner connector body 20 of FIG. 3 is molded of plastic material and is of a length to span across the width of one row 4 or 6. The body 20 is provided with a pair of apertures 24A and 26A, which align respectively with the windows 24 and 26. FIG. 5 illustrates the aperture 24A as having a sloped wall 36 defining a flared entry for the aperture. An inverted latching surface 38 is defined flush with the undersurface of body 20 and adjacent the smaller dimensioned end of aperture 36. FIG. 4 illustrates aperture 26A as having straight side walls, absent a latching surface as is provided adjacent aperture 24A. The body 20 further is provided with a plurality of undercut recesses 28A, 32A, 34A, and 30A, for alignment with the respective windows 28, 32, 34 and 30 of a row 4 or 6 of the cable 2. The cross section of recess 28A, shown in FIG. 6, also represents each of the similar cross sections of recesses 32A, 34A and 30A. A rounded elongate edge 40 is provided along the body 20 which will bear against the cable when assembled therewith in a manner to be described.

The unitary outer connector body 22, shown in FIG. 3, is molded from plastic material and includes a planar surface 42 for spanning across the width of a cable row 4 or 6. The surface 42 is recessed between cable aligning end walls 44 and 46 and a sloped cable supporting surface 48. The surface 42 is molded with integral projecting posts 28B, 32B, 34B and 30B, which pass through the windows 28, 32, 34 and 30 of a cable row 4 or 6 and frictionally press fit in the recesses 28A, 32A, 34A and 30A of an inner body 20, when an inner body 20 and an outer body 22 are assembled over a cable row 4 or 6, clamping the cable row between each other.

FIG. 3 also shows the surface 42 provided with a vertical opening 24B passing entirely through the body 22 and adapted for alignment with the window 24 of a cable row 4 or 6 and an aperture 24A of a body 20. The surface 42 also is molded with a projecting latch finger 26B. With the bodies 20 and 22 assembled together, the finger 26B will project through a window 26 of a respective cable row, and also through the window 26A of the body 20.

FIG. 7 illustrates each cable row 4 and 6 being assembled with a corresponding inner body 20 and outer body 22, with the surfaces 40 and 48 engaging the respective cable row across its surface width and providing a smooth, strain relief support over which the cable row is engaged while in a circuitous path between the clamped together connector bodies 20 and 22.

FIG. 3, taken in conjunction with FIGS. 3A and 7, illustrates the body 22 provided with an elongated channel 50 along the length of surface 42. A row of projecting molded plastic stuffers 52 project from the channel. The stuffers have flat top surfaces aligned with and supporting respective conductors 12 of one cable row. The spaces between the laterally spaced stuffers 52 are aligned with the windows 8. The body 22 further includes a row of flat top surface cable supporting projections 54 alongside the channel 50 engaging and supporting the cable and edge margin 14.

FIGS. 2, 8 and 9 illustrate a plug type or receptacle type electrical connector 55, more fully described in U.S. Pat. No. 3,760,335, and disclosed as having a mating side 56 and a wire connection side 58. A flange 60 encircles the connector 55 and separates the sides 56 and 58 from each other. The connector is provided with two rows of stamped and formed, metal strip electrical contacts 62 which extend to the connector mating side for frictional engagement with corresponding contacts of another connector intermated with the connector 55. The contacts 62 further extend to the connector side 58 where the contacts each includes a portion folded into a U-shape comprising two plates interconnected by a bight. A wire receiving slot passes through the bight and extends partially along each plate. Electrical connection is made when a conductor is forcibly inserted into the slot. The terminals 64 are arranged in two rows, facing in opposite directions at the connector mating side 58. The connector body is molded with integral plastic partitions 66 separating each terminal 64 from an adjacent terminal 64.

The cable conductors are electrically terminated in the terminals 64 when the outer connector bodies 22 are assembled over the terminals 64 and the partitions 66. In particular, the row 4 is first assembled with an outer connector body 22 and an inner connector body 20. The channel 50 of outer connector body 22 is aligned with a row of terminals 14, while the partitions 66 enter the windows 8. By forcibly pressing the outer connector body 22 over the partitions, the conductor portions exposed by the windows 8 will be engaged and pressed by the flat surfaces of the stuffers 52 into the slots of the terminals 64. The sides of the slot will engage the inserted conductors to establish gripping pressure sufficient to provide an electrical connection or termination of the conductors to the contacts 62. In the final assembly, the stuffers 52 will enter into the slot portions of the bights, as shown in FIG. 9. The U-shaped terminals 64 and the partitions will enter into the channel 50 of the outer body 22.

FIGS. 10 and 11 illustrate the cable row 4 with the flat conductors 12 laminated between the plastic laminates 12A and 12B. A corresponding row of terminals 64 of slotted plate form are aligned with the stuffers 52 on the outer body 22. The stuffers press the flat conductors 12 into the slots upon assembly of the body 22 over the terminals. The flat conductors are bent to a U-shape as they are inserted along the slots of the terminals. The side edges of the slots slice into the conductors and establish electrical connections therewith. The laminates 12A and 12B partially fill the slots above and below the conductors to maintain the conductors in desired configurations and in positions within the slots. Since the conductors tend to be maintained coplanar by the end edge margin 14, and by the remainder of the cable length, turning or twisting of the conductors 12 in the slots is avoided.

Similarly, the cable row 6 will have its conductors terminated to the other row of terminals 64 with the associated outer connector body 22 assembled over the other row of terminals.

FIGS. 2, 8 and 9 illustrate the final connector assembly. The inner connector bodies 20 are in back to back relationship with their apertures 26A and 24A in alignment. A latching finger 26B of each outer connector body 22 passes through the window 26 of the associated cable row, through the aperture 26A of the associated connector body 20, through the window 24 of the other cable row, and through the aperture 24A of a second body 20 that is assembled over the other cable row of conductors. An undercut shoulder 26C of the finger will overlap and thereby latch against the shoulder 38 of the second body 20. Accordingly, each latch finger passes through a first inner body 20 and latches to a second inner body 20. Clearance for the end of finger 26B is provided by the openings 24 and 24B.

The outer connector bodies 22 are latched together in the final assembly. One end of each body 22 is molded with a projecting hook finger 68 with an undercut shoulder 70. The other end of each connector body 22 is provided with a channel 72 to receive the finger 68 of the other body 22. The channel includes molded shoulders 74 against which the shoulder 70 of the hook finger overlaps and engages to latch the bodies 22 together.

FIGS. 12 and 13 illustrate the rows 4 and 6 with their conductors 12 offset vertically from each other, as shown with respect to a centerline 76. Each assembled connector body 22 is shiftable separate from the other to shift the corresponding cable row of conductors 12 into proper vertical registration with the respective row of connector contacts 12. A slight lateral shifting of the rows 4 and 6 is permitted by slack provided by their separated sections.

Although a preferred embodiment of the present invention has been described and shown in detail, other modifications and embodiments which would be apparent to one having ordinary skill in the art are intended to be covered by the spirit and scope of the claims.

What is claimed is:

1. A connector for flat cable conductors, comprising:

an inner connector body of all plastic construction assembled with an outer connector body of all plastic construction, a flat cable having a row of flat conductors clamped between said bodies, said cable having a row of first windows alongside said flat conductors, an electrical connector having a row of electrical contacts providing slotted plate electrical terminals separated by partitions, said outer body having stuffer means supporting the conductors of said cable and pressing said conductors into said slotted plate terminals upon assembly of said outer body over said partitions and said terminals, said partitions entering said first windows, said cable having second windows, and means on at least one of said bodies passing through said second windows and frictionally engaging the other of said bodies to clamp said bodies together over said cable.

2. A connector assembly for flat conductors disposed in two rows laminated together in a single flat cable, comprising:

a pair of outer connector bodies and a pair of inner connector bodies, and an electrical connector containing two rows of electrical contacts having conductor connecting terminal portions facing in opposite directions, flat conductors disposed in two rows laminated together except for unlaminated sections separated from each other, each said unlaminated section being clamped between an outer body and an inner body assembled together, first means interconnecting each said assembled outer body and an inner body in clamped relation, latching means extending from one outer body through a first inner body and latchably engaged to a second inner body, window means in said unlaminated sections for passage of said latching means therethrough, and securing means on said outer bodies for securing said outer bodies to each other and over said terminal portions, said outer bodies having integral plastic stuffer means engaging said conductors and pressing the same into electrical termination within said terminal portions.

3. The structure as recited in claim 2, wherein, each said cable row includes windows exposing side edges of said conductors, enabling said conductors to enter said terminal portions.

4. The structure as recited in claim 2, wherein, said first means includes projecting post on each said outer body and recess means in each said inner body frictionally receiving said post.

5. The structure as recited in claim 4, wherein, each said cable row includes additional window means for passage of said posts therethrough.

6. The structure as recited in claim 2, wherein, each said outer body includes a channel with said stuffer means projecting in a row along said channel, and said terminal portions project into said channel upon assembly of one said outer body over each row of said terminal portions.

* * * * *